United States Patent [19]

Linden-Smith et al.

[11] Patent Number: 5,063,333

[45] Date of Patent: Nov. 5, 1991

[54] DISCHARGE TUBE ARRANGEMENT

[75] Inventors: Neil A. Linden-Smith; Andrew T. Rowley, both of Leicester, Great Britain

[73] Assignee: Thorn Emi plc, London, England

[21] Appl. No.: 448,128

[22] Filed: Dec. 13, 1989

[30] Foreign Application Priority Data

Dec. 15, 1988 [GB] United Kingdom ..... 8829251

[51] Int. Cl.[5] ..... H01J 19/80

[52] U.S. Cl. ..... 315/326; 315/39; 315/267; 315/344

[58] Field of Search ..... 315/39, 248, 267, 326, 315/344; 313/607

[56] References Cited

U.S. PATENT DOCUMENTS

| | | | |
|---|---|---|---|
| 3,521,120 | 7/1970 | Anderson | 315/248 |
| 4,171,503 | 10/1979 | Kwon | 315/344 |
| 4,792,725 | 12/1988 | Levy et al. | 315/248 |

FOREIGN PATENT DOCUMENTS

| | | | |
|---|---|---|---|
| 0294004 | 12/1988 | European Pat. Off. . | |
| 1191482 | 4/1965 | Fed. Rep. of Germany | 315/248 |

OTHER PUBLICATIONS

Patent Abstracts of Japan, unexamined applications, E Field, vol. 8, No. 36, Feb. 16, 1984, The Patent Office Japanese Government, p. 37, E 227 *Kokai-No. 58-194 244 (Mitsubishi Denki K.K.)*.

Patent Abstracts of Japan, unexamined applications, E Field, vol. 12, No. 118, Apr. 13, 1988, The Patent Office Japanese Government, p. 63, E 600 *Kokai-No. 62-246 245 (Canon Inc.)*.

*Primary Examiner*—Eugene R. LaRoche
*Assistant Examiner*—Son Dinh
*Attorney, Agent, or Firm*—Fleit, Jacobson, Cohn, Price, Holman & Stern

[57] ABSTRACT

A discharge tube arrangement comprises a launcher and a discharge tube positioned in part within the launcher. When the launcher is energized with radio frequency (r.f.) power, surface waves are excited in the discharge tube which contains a fill. An electrically conductive structure extends along the discharge tube and is connected to an earth when in use. The structure is separated from the discharge tube by a radial distance such that, in use, the discharge tube produces an increase in total light output over the total light output of a discharge tube not having this structure. The structure comprises an insufficient quantity of material to obscure this increase in total light output.

9 Claims, 9 Drawing Sheets

DISCHARGE TUBE ARRANGEMENT

This invention relates to a discharge tube arrangement and in particular, though not exclusively, to such an arrangement for use as a light source.

It is known e.g. as disclosed in EP 0225753A (University of California), to generate and sustain a low pressure discharge in a gas by using electromagnetic surface waves. Surface waves are created by an energizer (also known as a launcher) which is positioned around and external of, but not extending the whole length of, a discharge tube containing the gas. In such an arrangement, it is not necessary to provide electrodes inside the discharge tube. The power to generate the electromagnetic wave is provided by a radio frequency (r.f.) power generator and EP 0225753A2 further discloses a grounded transparent r.f. shield surrounding the discharge tube.

It is envisaged that the radio frequency used can fall in the range of from 1 MHz to 1 GHz. However, in practice, it is believed that the operating frequencies which can be utilised by a discharge tube arrangement for use as a light source will be around 20 MHz, around 84 MHz or around 900 MHz, probably in the range of from 13 to 30 MHz.

It is known to provide a Faraday cage, e.g. a wire mesh, around a structure that is energised by radio frequency (r.f.) power to act an r.f. screening structure. The size of such a mesh is dependent, inter alia, on the frequency of the r.f. power used and the attenuation in r.f. power emitted that is required. To produce an attenuation of, say, 30dB at the frequencies of interest, the mesh used would be very fine, with a mesh size of the order of millimeters. This would tend to obscure light from the discharge tube, making the discharge tube arrangement an inefficient light source. A requirement for a higher attenuation to reduce the amount of r.f. interference to comply with international regulations would exacerbate the problem.

It is an object of the present invention to provide an improved discharge tube arrangement for use, inter alia, as a light source.

According to the present invention there is provided a discharge tube arrangement comprising:

a launcher suitable, when energised with radio frequency (r.f.) power, for exciting surface waves in a discharge tube containing a fill;

a discharge tube positioned in part within the launcher;

and an electrically conductive structure extending along the discharge tube, in use, said structure being connected to an earth wherein said structure is separated from the discharge tube by a radial distance such that the discharge tube produces an increase in total light output over the total light output of a discharge tube not having said structure, said structure comprising an insufficient quantity of material to obscure said increase in total light output.

It would be expected that if a structure extending along the discharge tube were provided, the quantity of material used would tend to obscure light emitted from the discharge tube and so a discharge tube arrangement having such a structure would emit less light than a discharge tube arrangement not having such a structure. However, the inventors have found that the provision of such a structure separated from the discharge tube by a certain radial distance increases the total light output of the discharge tube and that such a structure can comprise an insufficient quantity of material to obscure this increase in total light output. Thus, the the inventors have surprisingly found that a discharge tube arrangement comprising such an electrically conductive structure has a total light output greater than that of a discharge tube arrangement not having such an electrically conductive structure. A significant enhancement of total light output, of the order of 25 to 30% can be achieved. This increase in power is greater than the reduction in r.f. power emission caused by any r.f. screening property of the electrically conductive structure.

Preferably, the discharge tube arrangement further comprises means for producing an attenuation in r.f. power emitted from the discharge tube, said means surrounding the discharge tube and said structure.

Such a means provided sufficiently far away from the discharge tube is able to have an r.f. screening effect without obscuring light emitted from the discharge tube to an extent to counteract the effect of said structure.

Preferably said structure comprises a single strand of wire, advantageously a helical structure around the discharge tube. Such a structure provides the most improvement for a minimum quantity of light obscuring material.

In one preferred embodiment, the helical structure has a varying pitch along the length of the discharge tube. This alters the distribution of light output from different parts of the energised discharge tube.

Embodiments of the invention will now be described, by way of example only, and with reference to the accompanying drawings (not to scale) in which.

Figure 1:
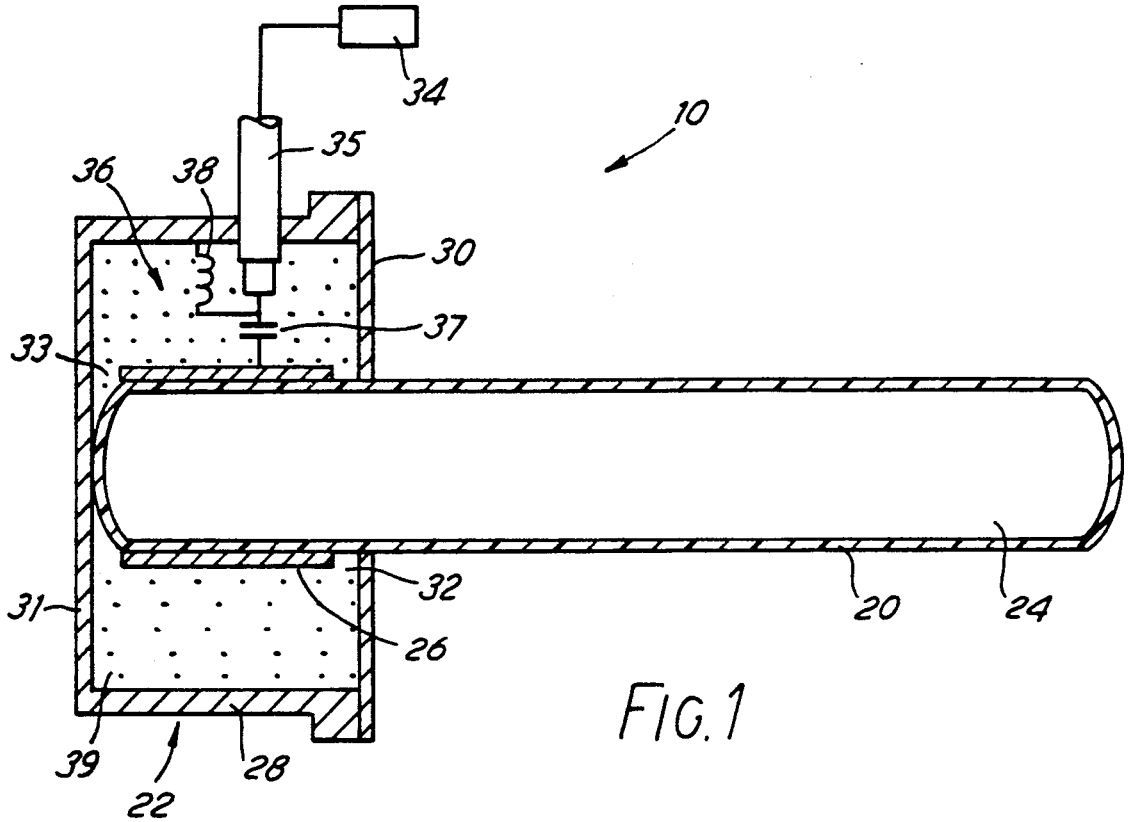
FIG. 1 shows a discharge tube arrangement not in accordance with the present invention.

As shown in FIG. 1, a discharge tube arrangement 10 comprises a discharge tube 20 mounted in a launcher 22. The discharge tube 20 is formed of a light-transmissive, dielectric material, such as glass, and contains a fill 24 of a noble gas, such as argon and an ionizable material, such as mercury.

The launcher 22 is made of an electrically conductive material, such as brass, and formed as a coaxial structure comprising an inner tube 26 and an outer tube 28. A first plate 30, at one end of the outer tube, provides a first end wall for the launcher structure. At the other end of the outer tube 28, a second plate 31, integral with the outer tube 28, provides a second end wall. The inner tube 26 is shorter than the outer tube 28 and so positioned within the outer tube 28 as to define a first annular gap 32 and a second annular gap 33. The first plate 30 has an aperture for receiving the discharge tube 20. The outer tube 28, the first plate 30 and the second plate 31 form an unbroken electrically conductive path around, but not in electrical contact with, the inner tube 26 to provide an r.f. screening structure therearound.

Suitable dimensions for the launcher of FIG. 1 are as follows:

| | |
|---|---|
| Launcher length | 7–20 mm |
| Launcher diameter (outer tube 28 diameter) | 25–35 mm but depends on size of discharge tube 20. |
| Inner tube 26 length | 3–18 mm |
| Inner tube 26 diameter | 13 mm but depends on size of discharge tube 20. |
| Length of Launching gap (first gap 32) | 0.5–3 mm |
| Length of second gap 33 | 1–10 mm |

The thickness of the electrically conductive material is of the order of millimeters, or less, depending on the construction method used.

An r.f. power generator 34 (shown schematically) is electrically connected to the inner tube 26 of the launcher 22 via a coaxial cable 35 and an impedance matching network 36 (shown schematically as comprising capacitor 37 and inductor 38). The connections are such that the r.f. signal is applied to the inner tube 26 while the outer tube 28 and end plates 30, 31 are earthed. The r.f. power generator 34, the impedance matching network 36, the coaxial cable 35 and the launcher 22 constitute an r.f. powered excitation device to energise the fill to produce a discharge.

A body 39 of dielectric material inside the launcher 22 is provided as a structural element, to keep the size of the gaps 32, 33 constant and to hold the inner tube 26 in position. The body 40 also helps in shaping the electric field in the gaps 32, 33 for ease of starting or other purposes. Suitable dielectric materials which exhibit low loss at r.f. frequencies include glass, quartz and PTFE.

When the r.f. power supply 34 is switched on, an oscillating electric field, having a frequency typically in the range of from 1MHz to 1GHz, is set up inside the launcher 22. At the first and second gap 32, 33, this electric field is parallel to the longitudinal axis of the discharge tube 20. If sufficient power is applied, the consequent electric field produced in the fill 24 is sufficient to create a discharge through which an electromagnetic surface wave may be propagated in a similar manner to the arrangement of EP 0225753A2. The first gap 32 is effective as the launching gap while the second gap 33 complements the effect of the first gap 32. Accordingly, the launcher 22 powered by the r.f. power generator 34 creates and sustains a discharge in the fill.

The length and brightness of the discharge depends, inter alia, on the size of the discharge tube 20 and the power applied by the r.f. power generator 34.

Furthermore, as indicated hereinbefore, it has been found that in a discharge tube arrangement, e.g. as shown in FIG. 1, an earthed electrically conductive structure extending along the discharge tube can be placed at such a radial distance from the discharge tube as to produce an increase in total light output over the total light output of a discharge tube arrangement not having this structure.

Figure 2:
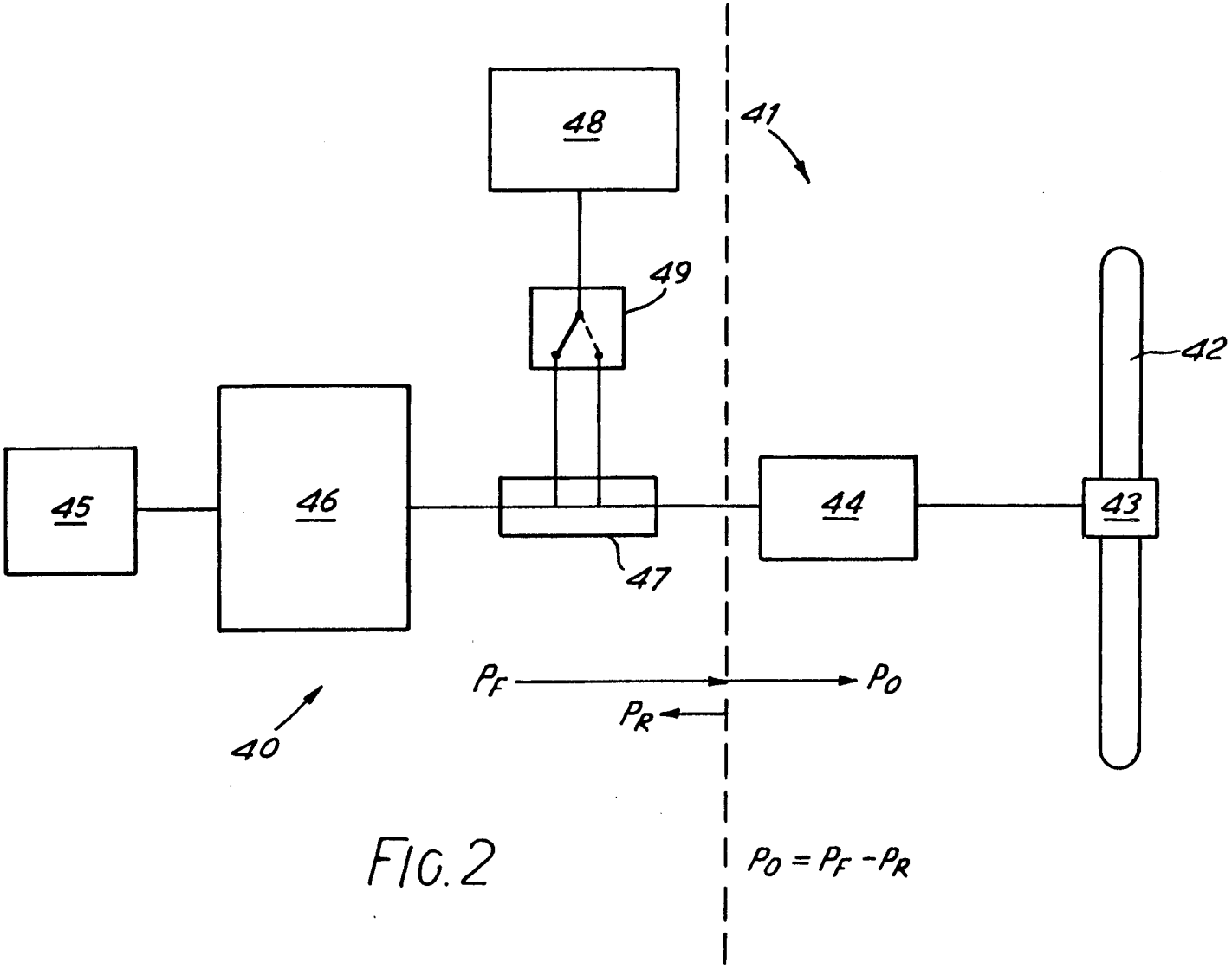
FIGS. 2 and 3 show apparatus used to determine the total light output from a discharge tube arrangement for a given power input.
Figure 3:
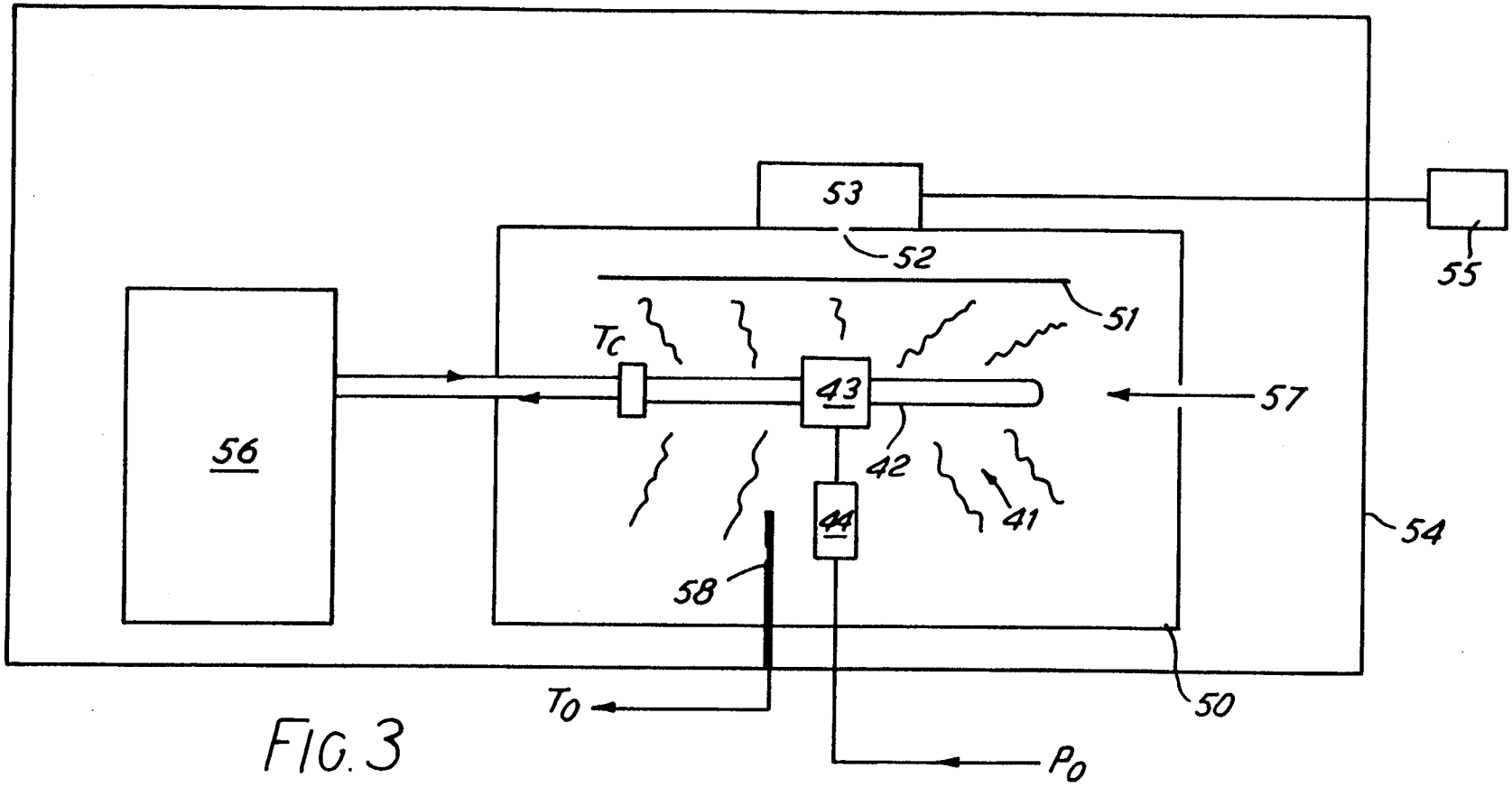

FIGS. 2 and 3 show apparatus used to determine the total light output from a discharge tube arrangement for a given power input. In essence, only two measurements have to be made: first, the power into the discharge tube arrangement and secondly the total light output given this power as input.

FIG. 2 shows the apparatus used to measure the power input from an r.f. power supply 40 to a discharge tube arrangement 41 shown schematically as a discharge tube 42, a launcher 43 and an impedance matching network 44 to match the impedance of the launcher 43 and discharge tube 42 to that of the power supply. The output of an r.f. signal generator 45 is amplified to a convenient level (typically about 10 W) by an r.f. amplifer 46 providing power to the discharge tube arrangement 41 through a bi-directional coupler 47. The coupler 47 couples out a small fraction of any r.f. power passing through it in both the forward direction (towards a load) and the reverse direction (any power reflected from a mismatched load). Two attenuators (not shown) reduce these signals to a level which can be measured by a power meter 48. An r.f. switch 49 allows a measurement of the forward power $P_F$ and the reflected power $P_R$ to be made using one power meter 48. The input power $P_O$ to the discharge tube arrangement 41 is given by the difference between the forward and the reflected power.

FIG. 3 shows the apparatus used to determine the total light output from the discharge tube arrangement 41. A non-conductive box 50 coated with white reflecting paint encloses the discharge tube arrangement 41 and effectively integrates any light emitted therefrom in all directions. A white painted baffle 51 is positioned to prevent any light directly from the discharge tube arrangement 41 reaching a small hole 52 in the box 50. The amount of light leaving the box 50 through the hole 52 is then proportional to the total light output of the discharge tube arrangement 41. This light output from the hole 52 is monitored by the combination 53 of a sensitive photodiode and an amplifier circuit mounted in an r.f. screened box. The output from this photodiode amplifier combination 53 is taken through the side of a Faraday cage 54 surrounding the whole system and monitored by a digital voltmeter 55.

Equipment for controlling the cool spot temperature $T_C$ of the discharge tube arrangement 41 is also shown in FIG. 3. This comprises a temperature controller 56 at one end of the discharge tube 42—the temperature is defined by the temperature of circulating water in contact with a small area at that end of the discharge tube 42. The temperature of the rest of the system is set, using warm air 57, at a temperature $T_O$ (measured by a screened thermocouple 58) greater than $T_C$. Thus the temperature defined by the temperature controller 56 is the cool spot temperature $T_C$ of the discharge tube arrangement.

A number of electrically conductive structures were tried. Measurements were made for some of these structures—for the majority of these measurements, the cool spot temperature $T_C$ was not controlled.

Figure 4:
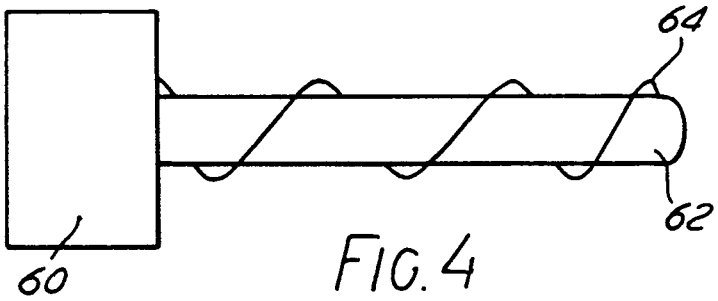
FIG. 4 shows schematically a first embodiment of discharge tube arrangement provided in accordance with the present invention.

The discharge tube arrangement of FIG. 1 is shown schematically in FIG. 4 and subsequent figures as a launcher 60 and a discharge tube 62. As shown in FIG. 4, a helical structure 64, having 3 turns, and formed of an electrically conductive material such as copper extends along the discharge tube 62. For the avoidance of doubt, it is hereby stated that the term 'helix' is defined as the three-dimensional locus of a point moving along and about a central axis at a constant or varying distance. Accordingly, the term 'helix' embraces structures of both constant and varying pitch. An earth connection is provided from the structure 64 to the outer tube of the launcher 60.

Figure 5:
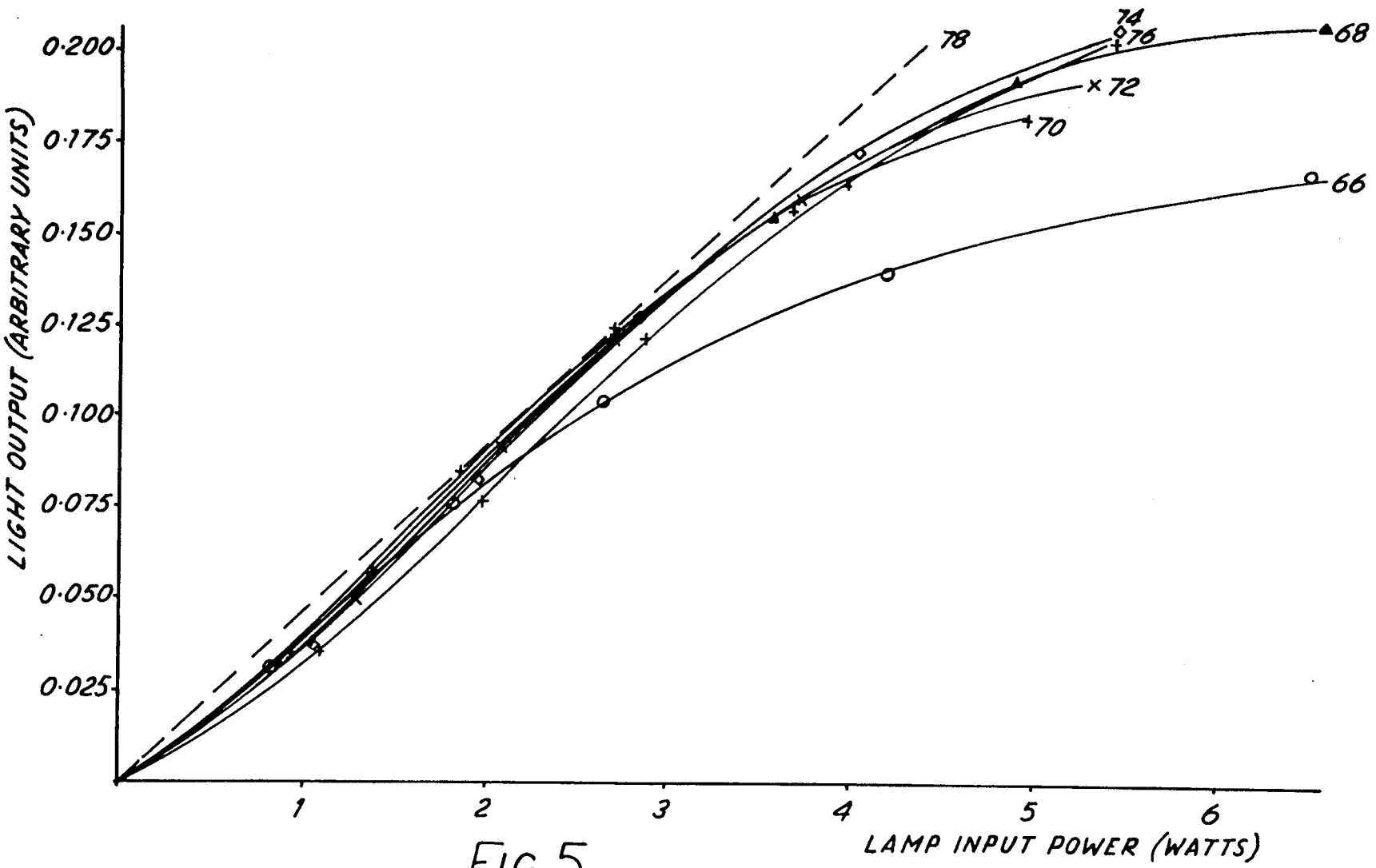
FIG. 5 shows the effect of the number of turns of a helical structure on the enhancement of total light output.

FIG. 5 shows the effect of the number of turns of a helix on the total light output produced by a discharge tube arrangement for a given light input power. The discharge tube 62 comprised an electrodeless fluorescent tube containing mercury and 5 torr argon of length 105 mm and internal diameter 13 mm. The helical structures were wound from tinned copper wire of diameter 0.56 mm. Helices with differing numbers of turns were wound around the tube and the light output was measured over a range of light input powers to about 10 W. For comparison, a measurement was made without a helix. All measurements were made using r.f. power of frequency 120 MHz. The key to the graphs is given below:

| Graph | Structure |
|---|---|
| 66 | No helix |
| 68 | Helix - 1 turn |
| 70 | Helix - 3 turns |
| 72 | Helix - 5 turns |
| 74 | Helix - 7 turns |
| 76 | Helix - 9 turns |
| 78 | indicates 50 lm/W. |

As can be seen from FIG. 5, at an input power of 5 W, the enhancement of total light output produced by the presence of a helix was about between 25 to 30% and this appeared to be independent of the number of turns (at least to within the measurement accuracy). Thus it is possible to provide a discharge tube arrangement having an electrically conductive structure extending along a discharge tube and electrically connected to the earth of the launcher which produces a total light output greater than the total light output of a discharge tube arrangement not having such a structure. It is appreciated that the provision of a helix with a large number of turns would improve the r.f. screening effect but this would be at the expense of obscuring the total light ouput from the discharge tube and so counteract the effect of the helical structure.

Figure 6:
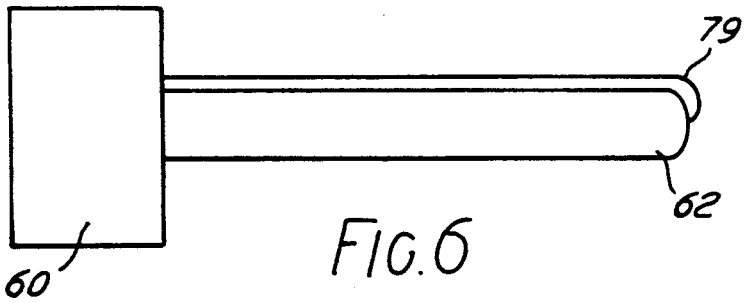
FIG. 6 shows schematically a second embodiment of a discharge tube arrangement provided in accordance with the present invention.

A structure comprising a straight wire 79 is shown in FIG. 6. This produced a total light output enhancement of about 20% at 5 W.

Figure 7:
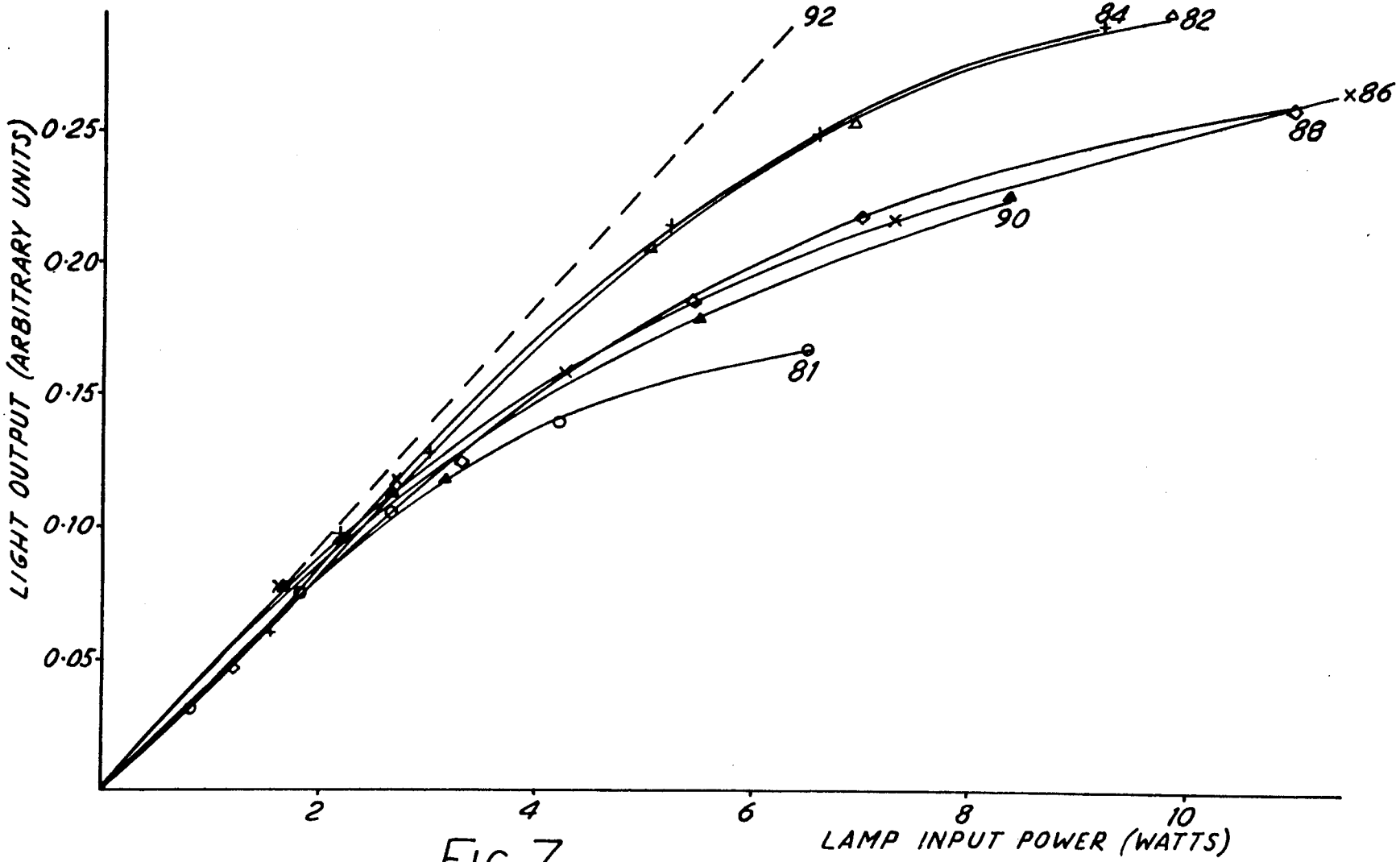
FIG. 7 shows the effect of the radial separation of the structure and the discharge tube wall on the enhancement of total light output.
Figure 8:
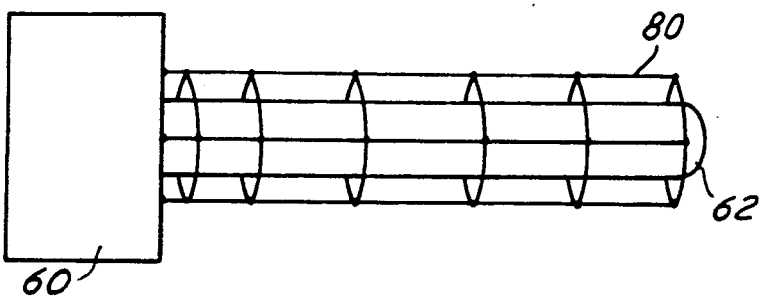
FIG. 8 shows schematically a third embodiment of a discharge tube arrangement provided in accordance with the present invention.

FIG. 7 shows the effect of the radial dimensions of a helix or other structure on the total light output produced by a discharge tube arrangement for a given light input power. The measurements were made using r.f. power of frequency 125 MHz. The discharge tube 62 comprised an electrodeless fluorescent tube of length 105 mm and internal diameter 13 mm containing 5 torr argon and mercury. The structures used were a helix of radius 7.5 mm (i.e. wound tight to the discharge tube) and cages of varying radii. Each cage 80, as shown in FIG. 8 comprised four vertical supports joined together by six loops. The structures were made of 0.56 mm diameter tinned copper wire.

The key to the graphs is given below:

| Graph | Structure |
|---|---|
| 81 | no structure |
| 82 | Helix - 3 turn - 7.5 mm radius |
| 84 | Cage - 7.5 mm radius |
| 86 | Cage - 20 mm radius |
| 88 | Cage - 31 mm radius |
| 90 | Cage - 37 mm radius |
| 92 | indicates 50 lm/W. |

As can be seen from FIG. 7, all the structures gave a significant increase in total light output compared to the case in which no structure was used. However, the helix and the 7.5 mm radius cage, which were both tight to the discharge tube wall, gave a substantial increase in total light output compared to the other structures. It is envisaged that for a discharge tube of diameter 15 mm, the structure will need to be within less than the greater of 5 cm or 5 times the diameter of the discharge tube, preferably within 12 mm of the discharge tube for a significant enhancement and within about 2.5 mm for maximum effect.

It is further to be noted, form FIG. 7, that the three turn helix produced an equal increase in total light output to a cage structure which contained at least 5 times as much material.

Figure 9:
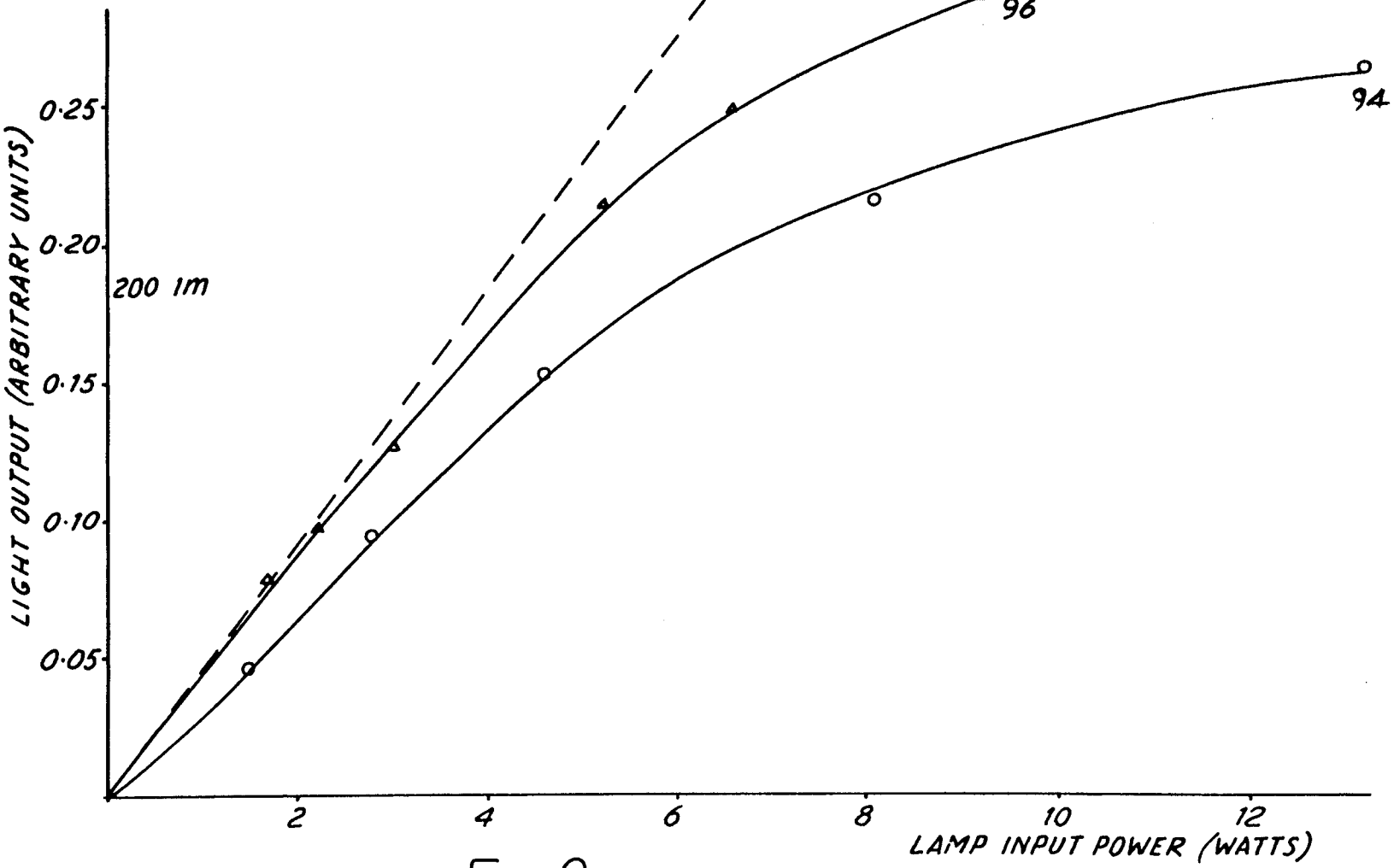
FIGS. 9 and 10 show the enhancement of total light output produced respectively by a helical structure and by a fine mesh.
Figure 10:
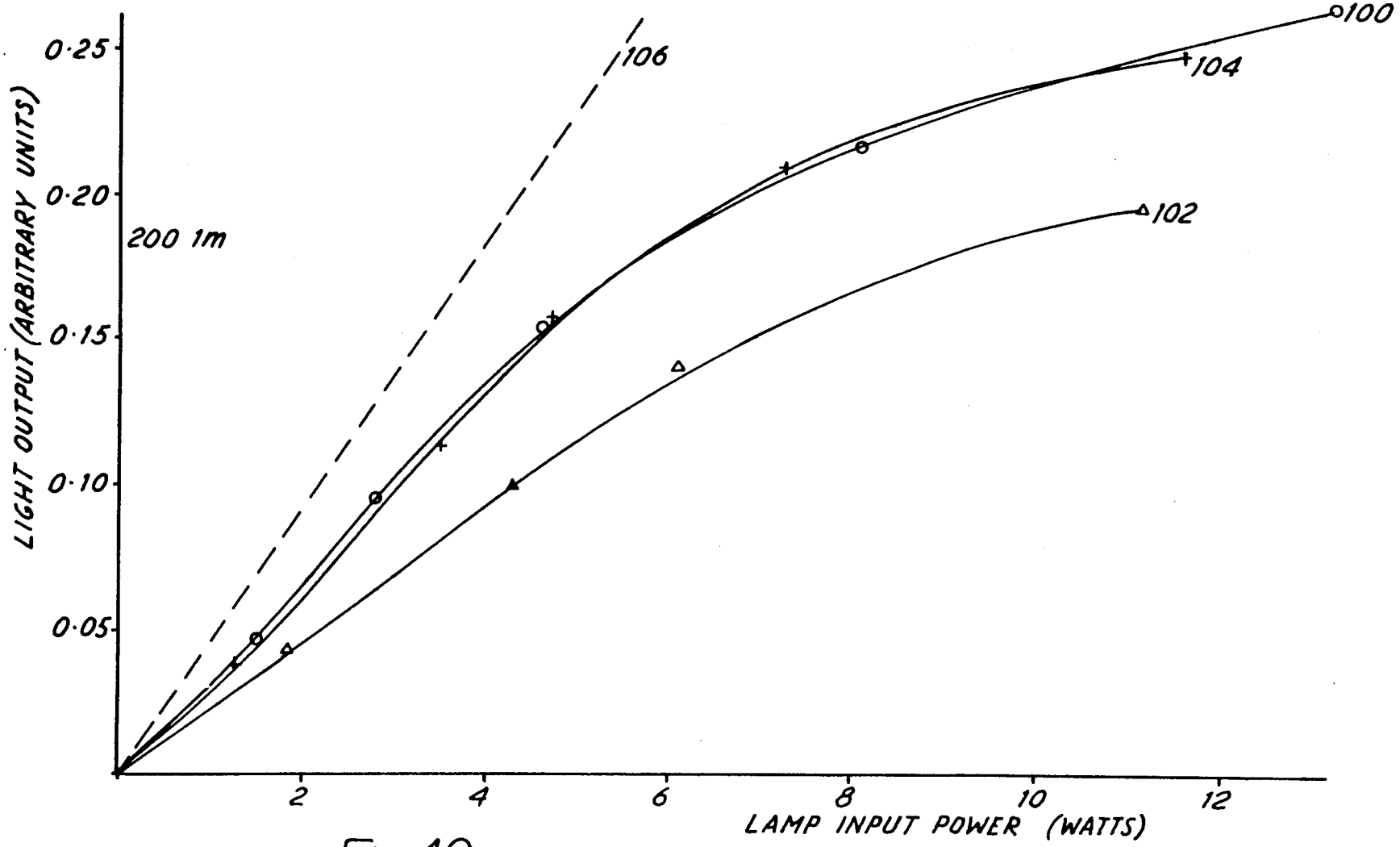

A further comparison of the effect of the amount of material in a structure can be made from the results shown in FIGS. 9 and 10. FIG. 9 shows the effect of a 5 turn helix structure wound tight to the discharge tube wall on the total light output of a discharge tube arrangement operated at 129 MHz. The key to the graphs is given below:

| Graph | Structure |
|---|---|
| 94 | no structure |
| 96 | earthed helix |
| 98 | indicates 50 lm/W |

The total light output from a discharge tube arrangement surrounded by an unearthed helix was identical to that without the helix present—the amount of material in a 5 turn helix is insufficient to obscure a measureable proportion of the light output. In this example, there was about a 25% increase in total light output caused by the presence of the earthed helix. Thus any mesh structure obscuring less than 25% of the surface area of the discharge tube would comprise an insufficient quantity of material to obscure the increase in total light output produced by the presence of the structure. For a mesh of wire thickness 0.55 mm, this results in a mesh hole size of about 4 mm.

FIG. 10 shows the effect of an aluminium mesh on the light output of a discharge tube arrangement operated at 129 MHz. The aluminium mesh had a wire thickness of 0.4 mm, a hole size of about 2 mm and was tight with the discharge tube wall. The key to the graphs is given below:

| Graph | Structure |
|---|---|
| 100 | No structure |
| 102 | Unearthed mesh |
| 104 | Earthed mesh |

-continued

| Graph | Structure |
|---|---|
| 106 | Indicates 50 lm/W |

As can be seen from these graphs, the material of the unearthed aluminium mesh obscures a large amount of the total light output from the discharge tube arrangement. Earthing the aluminium mesh produces an increase in light output which alleviates the problem of this obscuration though it is not so effective as a structure, such as the helix, which comprises less material.

Figure 11:
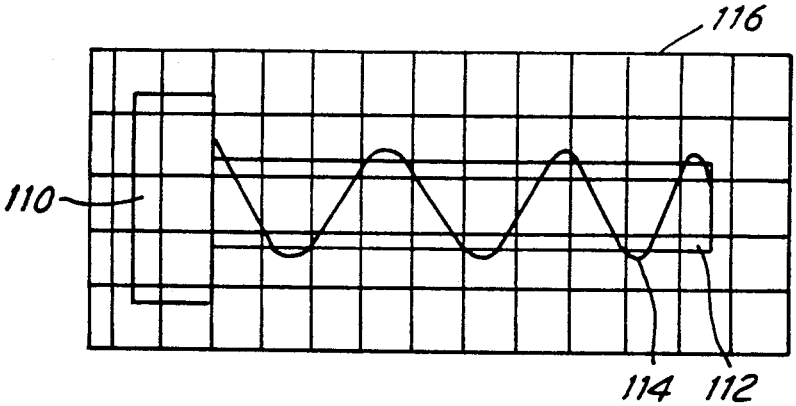
FIGS. 11 to 14 show schematically further embodiments of a discharge tube arrangement provided in accordance with the present invention.

It is to be noted that a simple 5 turn helix provides r.f. screening of the order of 15 dB. If this is insufficient, then a further structure can be provided, designed to have the required additional r.f. screening effect. FIG. 11 shows a discharge tube arrangement with a launcher 110, a discharge tube 112, a 5-turn helix 114 and an r.f. shield 116. For example, if the total attenuation of r.f. power emitted from the discharge tube is required to be 30 dB for a discharge tube arrangement operated at 100 MHz, the r.f. shield 116 would be required to produce an attenuation of about 15 dB which can be provided by a fairly coarse mesh of hole size of the order of 1 cm positioned at a distance of 3 to 4 tube radii from the discharge tube 112.

Figure 12:
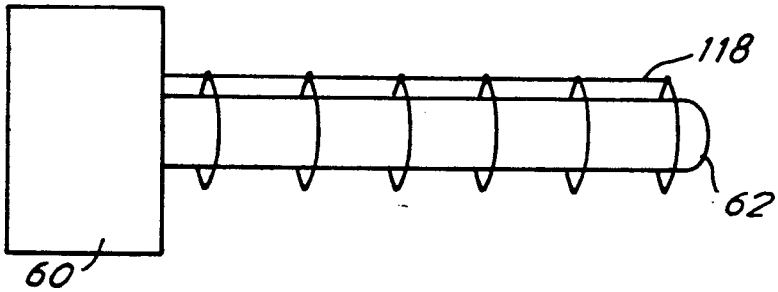
Figure 13:
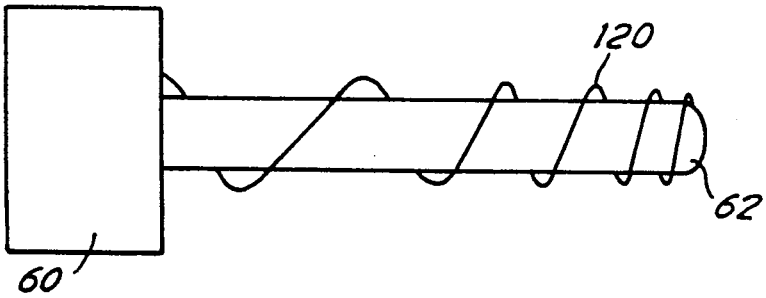
Figure 14:
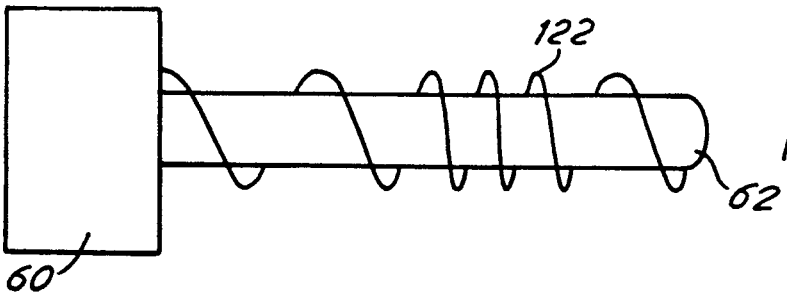

A variety of structures 118, 120, 122 which will produce an increase in total light output are shown in FIGS. 12 to 14. The brightness of the discharge at a particular position therealong can be varied by varying the pitch of the helix as shown in FIGS. 13 and 14.

Figure 15:
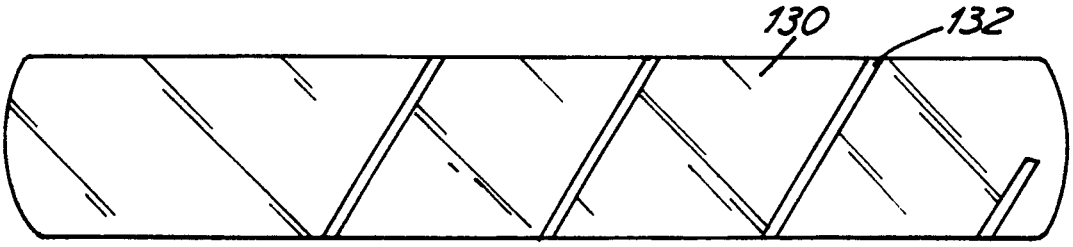
FIG. 15 shows, in elevation, a discharge tube on which a helical structure has been coated.

It has already been noted that those structures which were tight to the discharge tube wall gave a substantial increase in total light output compared to the other structrures of larger radial dimensions. FIG. 15 shows an electrodeless discharge tube 130 onto the external surface of which a 3 turn helix 132 has been coated. The discharge tube 130 is masked using tape to produce a stencil of the required structure and then the unmasked surface is coated using silver paint or by the vacuum coating of aluminium. It was found that the aluminium helix, which had a resistance of less than 1Ω, produced an increase in total light output similar to the increase effected by the copper wire helix wound tight to the discharge tube. The coating of the helix onto the discharge tube has the additional advantage of greater reproducibility. The silver painted helix had no measurable effect on the total light output of the discharge tube arrangement and this was believed to be due to its relatively high resistance (around 200Ω). In both cases, the earth connection from the helix 132 to the outer tube of the launcher included a wire ring around the discharge tube. The pitch of the helix was 20 mm.

Other modifications to the embodiments within the scope of the present invention will be apparent to those skilled in the art.

We claim:

1. A discharge tube arrangement comprising:

a launcher suitable, when energised with radio frequency (r.f.) power, for exciting surface waves in a discharge tube containing a fill, for producing a light output;

a discharge tube positioned in part within the launcher;

and an electrically conductive structure extending along the discharge tube, in use, said structure being connected to an earth wherein said structure is separated from the discharge tube by a radial distance such that, in use, said discharge tube produces an increase in total light output over the total light output of said discharge tube not having said structure, said structure positioned such that when in use it inherently intercepts the light output from the discharge tube and causes a reduction in total light output from the discharge tube, and wherein said structure has dimensions and is positioned such that, in use, said increase in total light output is greater than said reduction in light output caused by said structure obscuring said total light output.

2. A discharge tube arrangement according to claim 1 further comprising means for producing an attenuation in r.f. power emitted from the discharge tube, said means surrounding the discharge tube.

3. A discharge tube arrangement according to claim 1 wherein said structure comprises a single strand of wire.

4. A discharge tube arrangement according to claim 3 wherein the single strand of wire consists of a helical structure around the discharge tube.

5. A discharge tube arrangement according to claim 4 wherein the helical structure has a varying pitch along the length of the discharge tube.

6. A discharge tube arrangement according to claim 1 wherein said radial distance is less than the greater of 5 cm or 5 times the diameter of the discharge tube.

7. A discharge tube arrangement according to claim 6 wherein said radial distance is 2.5 mm or less.

8. A discharge tube arrangement according to claim 7 wherein said structure is contiguous with the discharge tube.

9. A discharge tube arrangement according to claim 7 wherein said structure is coated onto the external surface of the discharge tube.

* * * * *